3/18/80 XR 4,193,461

United States Patent [19]

Lamberton et al.

[11] 4,193,461

[45] Mar. 18, 1980

[54] MEANS AND METHOD FOR FORMING AND ENLARGING HOLES IN SOIL

[75] Inventors: Bruce A. Lamberton, Berea; Eduardo W. Bindhoff, Fairview Park, both of Ohio

[73] Assignee: Intrusion-Prepakt, Inc., Cleveland, Ohio

[21] Appl. No.: 877,091

[22] Filed: Feb. 13, 1978

[51] Int. Cl.[2] ..... E21B 11/02

[52] U.S. Cl. ..... 175/19; 175/40; 405/267; 405/271; 175/171

[58] Field of Search ..... 175/19, 20, 21, 24, 175/40, 50, 267, 171; 299/31, 60; 61/84–85; 405/267, 271

[56] References Cited

U.S. PATENT DOCUMENTS

| | | | |
|---|---|---|---|
| 845,120 | 2/1907 | Raymond | 175/21 |
| 3,387,893 | 6/1968 | Hoever | 175/267 X |
| 3,422,631 | 1/1969 | Silverman | 175/19 |
| 3,968,473 | 7/1976 | Patton et al. | 175/40 X |
| 4,079,795 | 3/1978 | Sackmann et al. | 175/24 |

FOREIGN PATENT DOCUMENTS

| | | | |
|---|---|---|---|
| 1157162 | 11/1963 | Fed. Rep. of Germany | 175/19 |

*Primary Examiner*—James A. Leppink
*Assistant Examiner*—Richard E. Favreau

[57] ABSTRACT

A hole is formed in soil by penetrating it with a tool comprising a shaft having a tapered point or auger of relatively small cross section attached to its lower end, and a series of outwardly pressing rams mounted on the shaft above the tapered point. The rams are effective successively to enlarge incrementally by outward compaction or displacement of the soil, the hole initially formed by the tapered point or auger. Full hole dimension above the tool is maintained by reason of the fact that the soil is incrementally compacted and compressed to resist collapse. If desired, the integrity of the hole may be preserved with the aid of a following shield, or the hole may be filled with soil stabilizing fluid such as drilling mud. After formation of the hole, the tool is withdrawn and the hole may be filled with concrete to form a load supporting column or it may be left as an open shaft.

The method and apparatus may also be used to enlarge the diameter of an existing hole.

8 Claims, 8 Drawing Figures

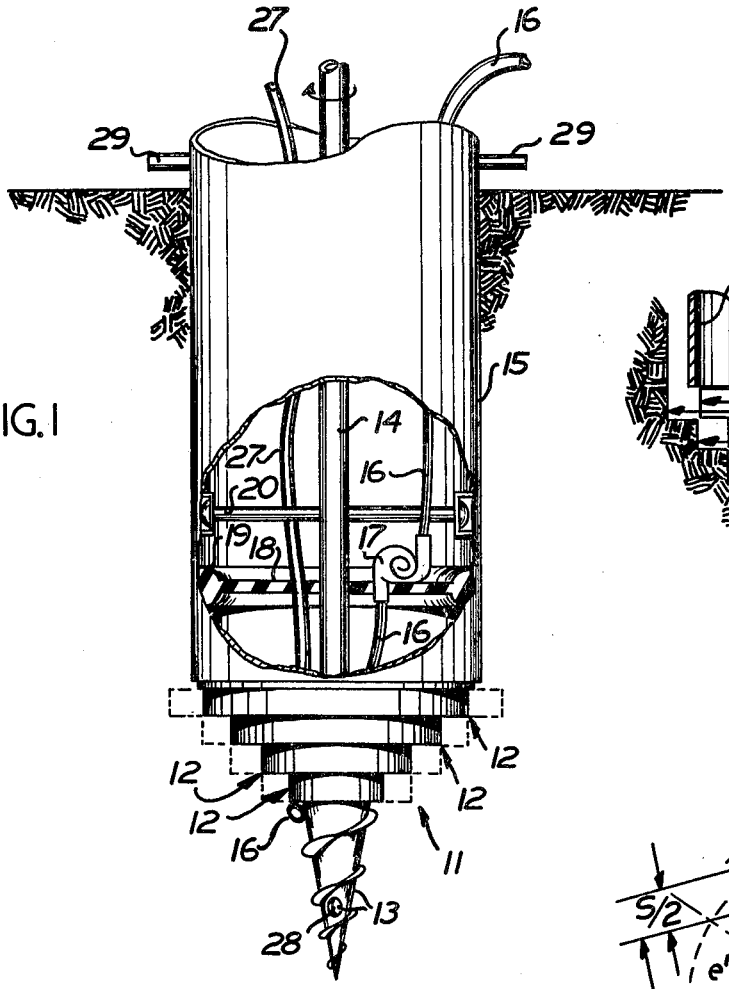
FIG.1
FIG.4
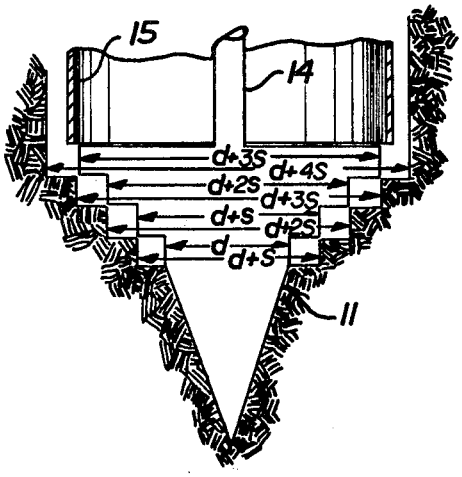
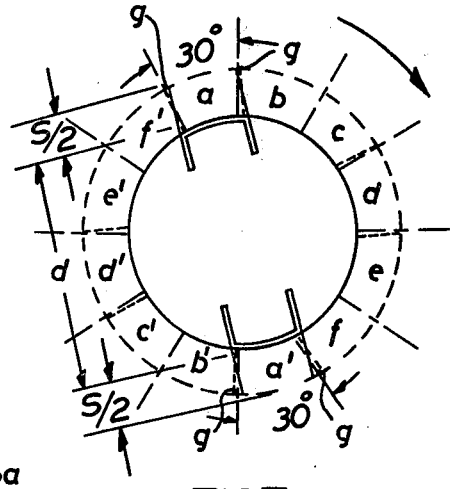
FIG.3
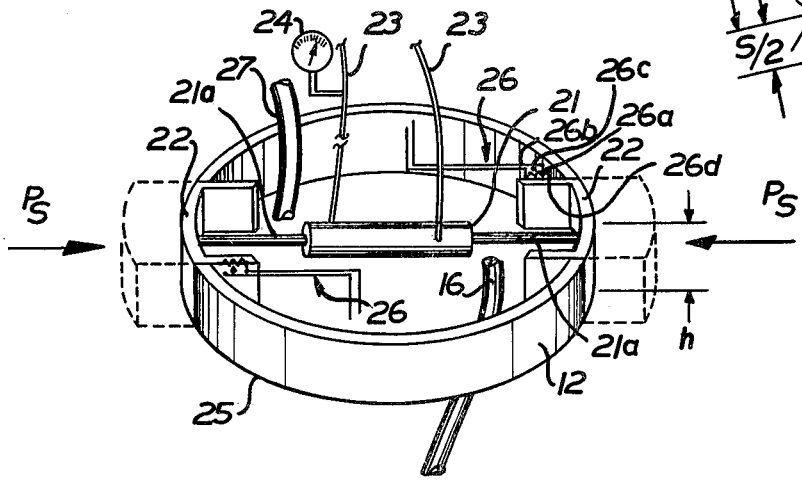
FIG.2

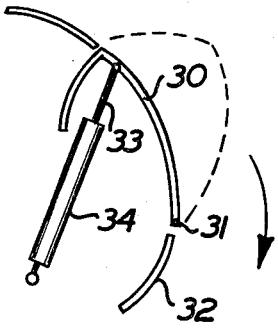
FIG.5
FIG.6
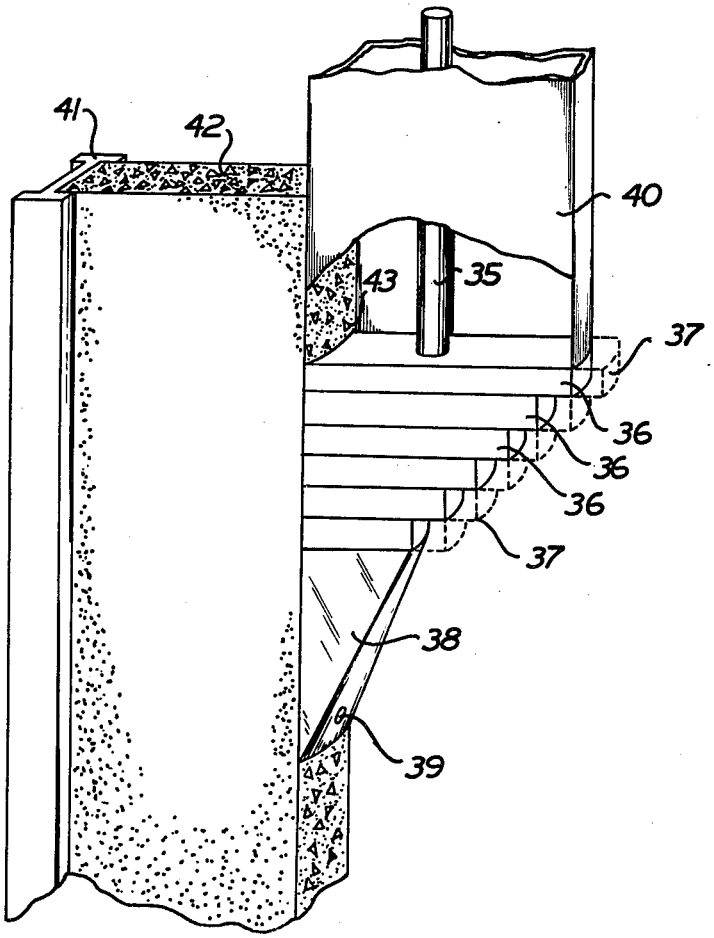

MEANS AND METHOD FOR FORMING AND ENLARGING HOLES IN SOIL

BACKGROUND OF THE INVENTION

1. Field of Invention

This invention relates to the formation of holes of relatively large diameter in soils such as silty clays, which are of such a composition and density as to be susceptible to compaction or displacement by application of a high intensity ramming force in relatively small increments.

2. Description of the Prior Art

Large diameter shafts on the order of 2 ft. to 15 ft. or more in diameter are commonly formed in such soft soils by sinking an open ended cylindrical steel shell or casing. Earth is removed from within the causing by means of an auger type excavating device or a grab type (clam shell) excavator. Vertical ramming force, occasionally with the addition of rotational, oscillatory, or vibratory forces, is often necessary to force the casing down into the soil. The soil presses tightly against the outer surface of the casing due to soil displacement and compaction. This increases frictional forces acting on the outer surface of the casing and makes downward moving of the casing difficult.

Underreaming tools may be employed in an effort to overcome the severe frictional forces tending to resist downward movement of the casing. These tools remove soil from beneath the lower edge of the casing and so remove resistance of the soil against this lower edge. But unless the soil is virtually self-supporting, friction will again build up along the outer surface of the casing resisting its downward movement.

In self-supporting soil, such as very stiff clay, the casing may be unnecessary. However, because soil density varies greatly and is of indeterminate quality, the reliability of this method is suspect. Personnel are not permitted to enter an uncased hole due to the danger of partial collapse of the hole. The uncertain results of this method, together with the attendant expense of loss of construction time in the event of a partial collapse, must always be considered as a possibility.

Present methods described above require massive equipment. A disposal cycle auger-type excavator, i.e., one which is raised out of the hole periodically to spin-off excavated soil, requires from 20 H.P. to 30 H.P. per foot of hole diameter and is typically capable of excavating holes up to six feet in diameter to a maximum practical depth of about 100 ft. In easily augered self-supporting soil, production rates up to 20 ft./hour may be achieved. Where casing of the hole is required, as in unstable soil, equipment requirements are increased and production rate greatly reduced. The cost of disposal cycle auger-type excavator equipment ranges from $60,000 to $150,000 and up.

Grab type excavators with which a shield is invariably employed, require somewhat less horsepower but achieve lower production rates. Equipment cost, including shield placing equipment, is somewhat greater than disposal cycle auger-type excavators. While both types of equipment are capable of penetrating very dense soil strata including those containing some cobbles and boulders and even low strength rock, they are unsuited to placing large diameter holes through soft soil at great depth, say on the order of 100 ft. and over. This unsuitability stems from uneconomically high power requirement, and from the progressively greater time and cost required for soil removal, as hole depth increases.

With the aid of pre-drilling techniques, very heavy steel casings can be driven to great depths through soil. These techniques are used in the construction of oil well drilling platforms in deep water. Equipment for driving these tubular casings up to 42" in diameter to depths of 400 ft. weigh as much as 300 tons and cost on the order of $1,000,000 and up. Equipment for driving such casings to depths of 1,000 ft., which will be required in the near future, is not available commercially at this time.

SUMMARY OF THE INVENTION

An object of this invention is to provide a method and apparatus for forming large diameter holes in soil by compaction and/or displacement of the soil.

Another object is to provide a method and apparatus for forming such a hole without the necessity of removing the soil therefrom.

Another object is to provide apparatus for forming such a hole in soil which apparatus is much lighter and more economical than equipment that is presently available.

Another object is to provide a method and apparatus for forming such a hole, the walls of which are compacted by ramming and so are far more stable and less susceptible to collapse than the walls of a similar hole from which earth has been excavated by customary means.

A further object is to provide a method and apparatus for enlarging the diameter of an existing hole.

Another object is to provide a method and apparatus for forming a hole in the earth which employs means providing instantaneous engineering data on the actual in situ strength of soil strata traversed, which data may be used in calculating the load carrying capacity of bearing members placed within the hole so formed.

According to the present invention, a tool is provided consisting of two or more ram assemblies, stacked one above the other, each comprising ramming means which may be actuated by any conventional means. From the bottom to the top of the tool, the ram assemblies or the strokes of their respective ramming means are successively longer and the ramming means are actuated either simultaneously or sequentially, with or without rotation of the entire tool, to compress or displace the soil to form a hole of incrementally increasing size. To permit entry of the lowest ram assembly into the soil, the soil beneath it is removed, for example by preboring with an auger, or displaced, for example, by rotating or driving a tapered point beneath the ram assembly into the soil.

Cementitious fluid such as a slurry of portland cement and water may be injected into the soil below or adjacent to the ram assemblies to assist in maintaining sidewall stability of the hole as the tool is advanced. A shield slightly smaller than hole size may be introduced into the hole immediately above the uppermost ram assembly to prevent collapse of the hole sidewalls.

By way of example, one embodiment of tool comprises a point tapering up to a diameter of 12", a series of ten ram assemblies, each having ramming means comprising one or more cylinders actuated by hydraulic fluid at a pressure within the range of about 5,000 to 10,000 psi. The ram assemblies range successively upward in length from 12" to 48" in 4" increments, each with a ramming means stroke slightly longer than 4" so mounted as to displace slightly more than 2" of soil on opposite sides of the ram assembly, with the ramming means at its extended position. The end of each ramming means is 4" in depth and has an arcuate ramming surface so selected as to displace slightly more than 30° of arc. The uppermost ram assembly is followed by a shield of 50" inside diameter.

The hole is advanced by activating the ramming means and then rotating the entire tool, including the ram assemblies and shield, in five 30° indexed steps, and actuating the ramming means at each step. For reasons explained more fully hereinafter, it may be desirable in certain instances to repeat the indexed steps a second time, with the tool radially displaced with reference to the first set of indexed steps. Thereafter the tool is lowered 4" into the hole formed by the ramming action.

This sequence of operation is repeated until the hole has been advanced to full depth after which the ram assembly is retracted and withdrawn with the shield, or through it, if the shield is to remain in place.

In non-cohesive soil, e.g., sand, cementitious fluids or slurries, such as Portland cement and water, or a drilling fluid consisting of a suspension of bentonite in water may be injected through the ram assemblies to act as a soil binder, inhibiting collapse of the rammed soil. The suspension may be passed upwardly through the annulus between the shield and the rammed soil, where it may function as a lubricating fluid to ease rotation of the shield as it is advanced downward into the hole.

In accordance with another embodiment of the invention the ram assemblies are of the same length, with each next higher ramming means having a stroke 4" longer than that of the next lower ramming means.

BRIEF DESCRIPTION OF THE DRAWINGS

FIG. 1 is a perspective view, with parts in section, of a tool of the present invention showing the arrangement of ram assemblies and shield;

FIG. 2 is a perspective view of ramming means in the form of one double acting ram of one of the ram assemblies illustrated in FIG. 1;

FIG. 3 is a diagram illustrating a typical sequence of operation of a single double acting ram of one of the ram assemblies illustrated in FIG. 1;

FIG. 4 is a sectional view of the ram assemblies of FIG. 1 and the hole formed by one operational cycle of the ram assemblies;

FIG. 5 is a fragmentary plan view illustrating an alternate embodiment of the present invention;

FIG. 6 is a fragmentary perspective view with parts in section, of a partially completed diaphragm wall and the employment of the tool of the present invention for constructing such a wall;

DETAILED DESCRIPTION OF THE INVENTION

Figure 7:
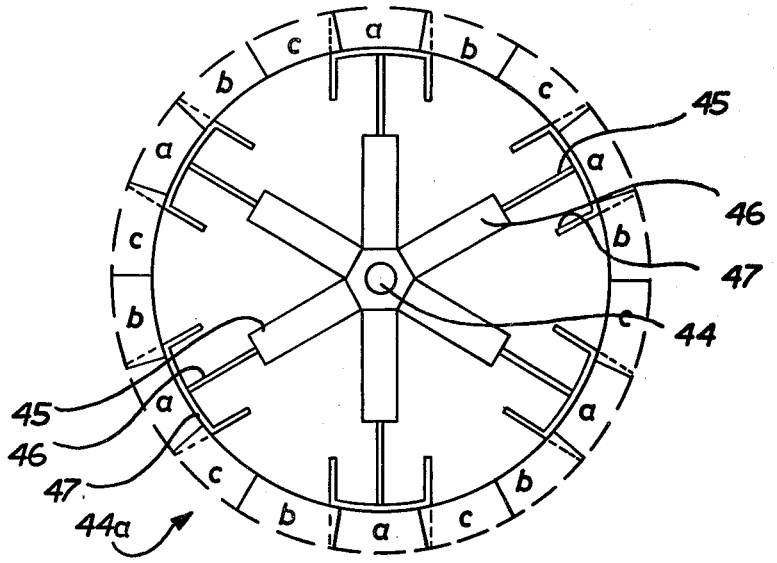
FIG. 7 is a fragmentary plan view of another alternate embodiment of ram assembly.

With reference to FIG. 1, it will be seen that the hole forming tool of the present invention, designated generally as 11, comprises a series of integrally connected, vertically disposed ram assemblies designated generally as 12, the lowermost of which is secured to lead point 13, which in the embodiment illustrated takes the form of an auger. The uppermost of ram assembly 12 is drivingly connected to shaft 14.

Hole forming tool 11 as illustrated in FIG. 1 is provided with an optional following shield 15, suitably connected for rotation with shaft 14, by braces 20 drivingly but releasably interconnecting shaft 14 with the inner surface of shield 15.

The hole forming tool is further provided with line 16 and pump 17 for removing drilling fluid and excavated soil from the situs, and line 27 for injecting drilling fluid or a soil stabilizing slurry of portland cement, which discharges through aperture 28 in lead point 13. In order to prevent drilling fluid or cementitious slurry discharged from aperture 28 from entering the interior of shield 15, the shield is provided with a fluid impervious diaphragm 18 disposed in sealing engagement with the shaft 14, and with the interior walls of shield 15 through peripheral seal 19.

Turning to FIG. 2, which illustrates in detail one of ram assemblies 12 shown in FIG. 1, it will be seen that the ram assembly comprises ramming means, which in the embodiment illustrated, takes the form of double acting hydraulic cylinder 21 whose piston rods **21*a* are in operative engagement with diametrically opposed ram shoes 22. The cylinder and ram shoes are so mounted that each ram shoe 22 moves outwardly a fixed and equal distance, so that the pressure of the surrounding soil, designated $P_s$, on one ram shoe 22** is counterbalanced by a pressure of equal magnitude on the opposed ram shoe, thereby maintaining centering and alignment of the entire assembly.

The ram assembly further comprises enclosing ring 25 to prevent contamination of the operating mechanism by the surrounding soil.

Hydraulic fluid under pressure is supplied (from a source not illustrated) to double acting cylinder 21 through fluid pressure lines 23, one of which is provided with pressure gauge 24.

Another feature of the invention is the provision of ram shoe position indicators designated generally as 26 which electrically record, and transmit to the tool operator the distance ram shoes travel following pressurization of cylinder 21. In the embodiment illustrated the indicator takes the form of a resist wire **26*a* mounted on ram shoe 22, having one end permanently connected to lead 26*b*, and making sliding contact with wiper 26*c* connected to lead 26*d*. An ohmmeter (not shown) is connected to the distal ends of leads 26*b*, 26*d***, which provides a readout of the distance the ram shoe has moved, as a function of the resistance tapped between the leads.

Referring to FIG. 3, the operation of ram assembly 12 is as follows. With ram shoes 22 aligned with sectors a-a' as illustrated in the figure, hydraulic fluid under pressure (from a source not illustrated) is admitted through lines 23 (FIG. 2) actuating the pistons of the double acting cylinder, causing ram shoes 22 to move radially outwardly a distance S/2, thereby compacting soil segments a-a'. Ram shoes 22 are then retracted, for example by the use of return springs or the application of hydraulic pressure to the outbound surfaces of the pistons, and the tool is indexed through an angle of 30°, placing ram shoes 22 in registry with segments b-b'. Hydraulic fluid under pressure is again introduced into lines 23 (FIG. 2), causing the double acting cylinder and its associated piston rods to force ram shoe 22 outwardly a distance S/2, thereby compacting soil segments b-b'.

The cycle continues by the tool being serially indexed in 30° increments to compact soil segments c-c', d-d', e-e' and f-f'.

It will be noted that due to the geometry involved, small wedges of soil g (FIG. 3) will remain uncompressed after one complete cycle of indexing ram shoes 22. If desired or necessary, these segments can be compressed by running the tool through a second indexed cycle, radially offset from the first cycle. For example, a 15° offset for the second indexed cycle would place ram shoe 22 in a position where its actuation would compress a segment g.

Alternatively, the creation of wedges g can be avoided by incrementally indexing the tool through an arc of somewhat less than 30°. Thus, ram shoe 22 would be indexed from segment a to segment b in FIG. 3 through a suitable arc such that the left edge of ram shoe 22 will contact the outer periphery of the hole at or slightly to the left of the base of wedge g.

It will be appreciated that the avoidance of creating wedges g can also be effected by retaining the 30° indexing arc, while providing ram shoes 22 which are sufficiently over-sized to provide a slight overlap of contact area at the outer periphery of the hole.

Upon completion of the cycle or cycles by any of the procedures described above, the tool 11 may be lowered further into the excavation a distance h equal to the height of ram shoes 22 (see FIG. 2).

FIG. 4 shows the relative dimensioning of the ram assemblies, and how this dimensioning interacts to provide an incremental increase in the diameter of the excavation. The lowermost ram assembly with its ramming means in the retracted position has a diameter of d and an effective diameter with its ramming means in the extended position, of d+s. The next above ram assembly with its ramming means in the retracted position has a diameter d+s and an effective diameter of d+2s with its ramming means in the extended position. The next above ram assembly with its ramming means in the retracted position has a diameter of d+2s and an effective diameter of d+3s with its ramming means in the extended position. Finally, the uppermost ram assembly with its ramming means in the retracted position has a diameter of d+3s and an effective diameter of d+4s with its ramming means in the extended position.

It will be seen that as each of the ram assemblies is indexed through its 360° cycle, the entire tool can be lowered into the excavation a height h which is equal to the height of ram shoe 22.

Where it is desirable or necessary to employ a drilling fluid to act as a vehicle for removal of displaced soil, fluid is introduced through line 27 and discharged into the excavation through aperture 28 in lead point 13. The fluid may then be pumped out employing pump 17 and line 16.

In some instances it may be desirable to utilize the drilling fluid as a lubricating agent, particularly where following shield 15 is employed. In such circumstances, a valve (not illustrated) can be placed in line 16 and the discharge flow of drilling fluid through line 16 can thereby be partially or completely blocked, forcing the drilling fluid around the periphery of ram assemblies 12 and into the space between the excavation and the outer wall of following shield 15.

To assist in maintaining side wall stability of the ram in the soil, a soil stabilizing fluid such as a slurry of portland cement and water may be injected into the excavation. To this end, the slurry may be introduced into line 27 and discharged through aperture 28 in lead point 13.

In order to prevent drilling fluid and soil stabilizing fluid from passing upwardly through the interior of the following shield 15, there is provided liquid impermeable diaphragm 18 disposed in liquid sealing engagement with the shaft 14, and through seal 19, in liquid sealing engagement with the interior surface of following shield 15.

Following shield 15 may be dispensed with where the excavation is formed in soil which is securely stabilized by ramming action. Where soil conditions dictate the use of following shield 15, it is convenient to transmit torque to the shaft 14 from beyond the outer surface of the shield, for example, by applying a turning force to members 29. The force is transmitted to shaft 14 by braces 20. Rotation of shield 15 provides the additional advantage of lessening the tendency of the shield to bind in its frictional engagement with the surrounding soil. This facilitates the advancement of the shield into the soil as well as its later removal if required. To permit operation of the hole forming tool without the shield, it is necessary to provide suitable means (not illustrated) for releasably securing the shield to braces 20, or for releasably securing braces 20 to shaft 14.

After hole forming tool 11 has been advanced to full desired depth, ram assemblies 12, or at least the uppermost ram assembly, is fully retracted and the tool may be removed by application of upward hoisting force on the tool. A hardenable cementitious slurry such as mortar or concrete may be injected through line 27 and discharged through aperture 28 in lead point 13, as the tool is withdrawn, to form a structural bearing member. Shield 15, if used, may be left in place or withdrawn.

To start the excavation of a hole, tool 11 is advanced into a pilot hole having a diameter approximately equal to the retracted diameter d of the lowermost ram assembly. The pilot hole may be formed by conventional means such as a displacement screw on lead point 13, which is advanced into the soil by rotating shaft 14. In soft soil, the pilot hole may be formed simply by lowering tool 11 and permitting lead point 13 to sink into the soil under the weight of the tool. In hard soil, it may be necessary to inject drilling fluid under high pressure into line 27 and to remove the drilling fluid and displaced soil through line 16 and discharge pump 17.

Under circumstances where it is desirable to operate the tool without a lead point, it is necessary to separately predrill a hole at least equal in diameter to the retracted diameter of the lowermost ram assembly.

By way of example, and with reference to FIGS. 2, 3, cylinder 21 may be actuated by hydraulic fluid at pressures in the range of 5,000 to 10,000 psi. The working surface area of ram shoe 22 and its ratio with the surface area of the piston in the cylinder 21 may be selected so as to permit application of a ramming force against the soil on the order of 1,000 psi. Since the flow rate of the hydraulic fluid is relatively low, on the order of one-quarter to one-half gallon per minute per cylinder, overall horsepower requirements of the ram assemblies may be as low as two and one-half horsepower per foot of hole diameter.

The embodiment described above utilizes horizontally opposed ram wing means movable radially with respect to the shaft of the hole forming tool. The invention contemplates hole forming tools in which the movement of the ram wing means follows different paths with respect to the shaft of the tool, and one such arrangement is illustrated in FIG. 5. Here, the ramming means comprises ram shoe 30 which is pivotally mounted at 31 to shell 32. The free end of ram shoe 30 is connected to piston rod 33 which in turn is connected to hydraulic cylinder 34. The location of ram shoe 30 in its extended position is illustrated in phantom lines.

The invention may also be used to advantage in the formation of noncircular apertures. One such application is the construction of diaphragms of concrete within a soil body as illustrated in FIG. 6. Here the hole forming tool comprises shaft 35 upon which are mounted a series of vertically disposed, stepped ram assemblies 36 which, by incremental ramming action of ram shoes 37 enlarge a small slot shaped hole initiated by lead point 38. Drilling fluid may be pumped through shaft 35 and discharged from aperture 39 in lead point 38 to lubricate passage of the tool through the soil, and to aid in the compaction, displacement and/or removal of soil particles. Following shield 40 may be used to maintain stability of the side walls of the hole during its formation.

In operation, it may be convenient to first drive into the soil structure steel member 41 which serves as a reaction member against which ram assemblies 36 push during formation of the first concrete diaphragm panel 42. Once this first panel is formed and the concrete has hardened, the panel itself serves as a reaction member, during formation of the adjacent panel. The leading edge of each panel may be shaped, for example as illustrated at 43, to provide alignment means for the formation of succeeding concrete panels.

A further embodiment of the invention is illustrated in FIG. 7. Here the hole forming tool comprises shaft 44, and a ram assembly designated generally as **44*a*, having ramming means comprising a series of hydraulic cylinders 45 disposed radially and symmetrically with respect to shaft 44. Each hydraulic cylinder 45 is of the single acting variety, and through piston rod 46, actuates ram shoe 47**.

The ram wing means thus described, consisting of six ram shoes, each actuated by its own hyraulic cylinder, permits simultaneous actuation of all cylinders 45. Since each cylinder is opposed by a separately actuated cylinder 180° out of phase with it, simultaneous operation of opposed cylinders provides a counter-balancing of identical forces in opposite directions, maintaining the centering and alignment of the hole forming tool.

The advantage of the arrangement illustrated in FIG. 7 is that the tool need be indexed less frequently to effect an enlargement of the entire periphery of the excavation. Thus, with hydraulic cylinders 45 actuated in the positions illustrated in FIG. 7, ram shoes 47 will compact soil segments a. By indexing the tool a first time, and actuating hydraulic cylinders 45, ram shoes 47 will compact soil segments b. By indexing the tool a second time and actuating hydraulic cylinders 45, ram shoes 47 will compact soil segment c. In this manner, the entire periphery of the aperture, consisting of soil segments a, b and c, is compacted with only two indexing steps of the hole forming tool. Further, it will be seen that sufficient overlap of ramming trajectory is provided so that substantially continuous soil compression is effected along the periphery of the hole.

Figure 8:
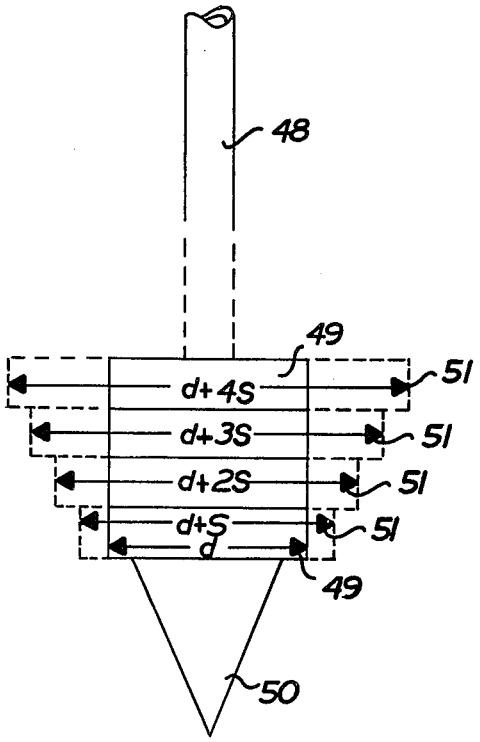
FIG. 8 is a fragmentary elevation view of another alternate embodiment of tool in accordance with the present invention.

In the various embodiments illustrated above, the ram assemblies and the retracted positions of the corresponding ramming means have been fashioned stepwise, while the length of movement of ram wing means from the retracted position to the extended position have been held constant. FIG. 8 illustrates an embodiment of the hole forming tool in which the reverse is true.

With reference to FIG. 8, it will be seen that the hole forming tool comprises shaft 48 upon which are mounted a series of ram assemblies 49 and lead point 50. It will be noted that the superposed ram assemblies are all of identical diameter. It will be noted however that the distance the ram shoes 51 move from a retracted to an extended position varies incrementally. Thus, the lowermost ram shoe 51 moves a distance s/2 from its retracted position to its extended position while the next above ram shoe 51 moves a distance of s. The uppermost ram shoe 51 moves a total distance of 4s from its retracted position to its extended position. In all other respects the operation of the ram assembly illustrated in FIG. 8 is substantially the same as that described in connection with the embodiment illustrated in FIGS. 1-4.

As previously indicated the method and apparatus of the present invention may also be used to enlarge an existing hole. Such an existing hole may be one which was drilled in a relatively small diameter to satisfy one purpose, and which now can serve a new function if enlarged.

In some situations it may be desirable to form a pilot hole for example of diameter d (FIG. 4), by conventional means, before employing the method and apparatus of the present invention. This has the effect of reducing the amount of soil compaction which must be accomplished by the method and means of the present invention. This could be advantageous when operating in soils which are difficult to compact.

If the existing hole has been filled with drilling mud to effect dimensional stability of the hole, it would be advantageous to retain lead point 13. If the existing hole is empty, and extends to the desired depth, the lead point can be dispensed with.

It will be appreciated that other embodiments, modifications, variations and applications of the invention will occur to those having ordinary skill in the art. For example, hole forming tools can be designed to form asymmetrical excavations as well as circular excavations. Further, the excavations need not be vertical as generally illustrated in the figures accompanying the application, but may be horizontal and at any angle between the horizontal and vertical.

Having thus described our invention, we claim:

1. A tool for forming or enlarging a hole in soil or similar earthen materials comprising a shaft having a bottom end adapted to be lowered into a hole as it is formed, a first ram assembly having a circular periphery of larger diameter than the cross-section of said shaft, concentrically mounted on said shaft near the bottom end thereof, said first ram assembly comprising at least one ram shoe moveable from a retracted position where the ram shoe forms a sector of the circular periphery of said first ram assembly, to an extended position where at least a portion of the ram shoe is disposed at a point which is a finite radial distance beyond the circular periphery of said first ram assembly, the generatrix of such points defining a first periphery of soil compaction, and means for moving said ram shoe between said retracted and extended positions, a second ram assembly mounted on said shaft above said first ram assembly having a circular periphery which is equal to or slightly less than said first periphery of soil compaction, said second ram assembly comprising at least one ram shoe moveable from a retracted position where the ram shoe forms a sector of the circular periphery of said second ram assembly, to an extended position where at least a portion of the ram shoe is disposed at a point which is a finite radial distance beyond the circular periphery of said second ram assembly, the generatrix of such points defining a second periphery of soil compaction.

2. The tool defined in claim 1 further comprising means for moving said ram shoes, along radial paths with respect to said shaft.

3. The tool defined in claim 1 further comprising means for moving each of said ram shoes pivotally about a point radially displaced with respect to said shaft.

4. The tool defined in claim 1 further comprising means for measuring the forces exerted by said ram shoes against the soil surrounding the hole.

5. The tool defined in claim 1 further comprising means for rotating said shaft.

6. The tool defined in claim 5 further comprises a cylindrical shield mounted for rotation with said shaft, said shield being mounted above said second ram assembly.

7. The tool defined in claim 6 further comprising means for introducing fluids below the ram assemblies.

8. The tool defined in claim 7 further comprising barrier means positioned above said ram assemblies to prevent fluids introduced therebelow from rising to the surface through said cylindrical shield.

* * * * *